US005505500A

United States Patent [19]

Webb et al.

[11] Patent Number: 5,505,500

[45] Date of Patent: Apr. 9, 1996

[54] APPARATUS FOR PREVENTING GENERATION OF FUGITIVE EMISSIONS AT A DRAIN SITE

[75] Inventors: James E. Webb, Richmond; Joseph R. Barocio, Jr., Cordelia, both of Calif.

[73] Assignee: Nsertaseal Corporation, Richmond, Calif.

[21] Appl. No.: 392,190

[22] Filed: Feb. 22, 1995

[51] Int. Cl.[6] ..... F16L 27/10

[52] U.S. Cl. ..... 285/223; 285/177; 285/293; 403/223; 137/375; 24/442

[58] Field of Search ..... 285/42, 177, 223, 285/235, 260, 293; 403/223; 24/306, 442; 137/375; 277/212 FB

[56] References Cited

U.S. PATENT DOCUMENTS

| | | | |
|---|---|---|---|
| 262,310 | 8/1882 | Ohlinger | 285/235 |
| 959,777 | 5/1910 | May | 285/223 |
| 1,633,988 | 6/1927 | Jones . | |
| 2,453,001 | 11/1948 | Stefano . | |
| 3,116,774 | 1/1964 | Callahan . | |
| 3,926,458 | 12/1975 | Dryden | 285/177 |
| 3,941,159 | 3/1976 | Toll | 24/442 |
| 4,114,669 | 9/1978 | Bishop . | |
| 4,142,565 | 3/1979 | Plunkett, Sr. . | |
| 4,207,918 | 6/1980 | Burns et al. | 137/375 |
| 4,556,082 | 12/1985 | Riley et al. . | |
| 4,688,473 | 8/1987 | Eriksson . | |
| 4,930,543 | 6/1990 | Zuiches | 137/375 |
| 5,005,531 | 4/1991 | Nelson . | |
| 5,102,537 | 4/1992 | Jones . | |
| 5,219,403 | 6/1993 | Murphy . | |

*Primary Examiner*—Terry Lee Melius
*Assistant Examiner*—Heather Shackelford
*Attorney, Agent, or Firm*—Thomas R. Lampe

[57] ABSTRACT

A sleeve member is positioned between an outlet pipe and a drain structure to form a fluid flow passageway isolated from the ambient atmosphere to confine fluid emissions from either the outlet pipe or the drain structure and prevent the fluid emissions from entering the ambient atmosphere. The sleeve member includes two sleeve ends of different diameters and an intermediate sleeve member segment having a truncated cone configuration flaring outwardly and downwardly from the uppermost sleeve end to the lowermost sleeve end.

18 Claims, 2 Drawing Sheets

APPARATUS FOR PREVENTING GENERATION OF FUGITIVE EMISSIONS AT A DRAIN SITE

TECHNICAL FIELD

This invention relates to apparatus utilized at industrial and other drain sites wherein fluid material is emitted from a drain pipe positioned above a drain structure inlet opening. For example, the invention has application to petrochemical installations and facilities wherein deployment of an outlet pipe relative to a drain structure in the manner just described is relatively commonplace.

BACKGROUND ART

Disposition of outlet pipes above drain structures can cause problems. For example, fugitive emissions can be generated by wind turbulence and such emissions introduced into the ambient atmosphere. It will be appreciated that certain substances can produce potentially harmful emissions. Also, of course, deployment of an outlet pipe above a drain structure can result in unwanted splashing of liquid. Furthermore, certain substances can freeze in such an operational environment at low temperatures.

The present invention incorporates a sleeve member extending between the outlet pipe and the drain structure to prevent escape of fugitive emissions into the ambient atmosphere, prevent splashing of liquid or other material beyond the confines of the sleeve member, and provide some protection against freezing at low ambient temperatures.

It is known to provide insulating jackets, sleeves and the like about various types of equipment to provide protection against the elements in one way or another. The following patents are believed to be representative of the state of the prior art: U.S. Pat. No. 4,566,082, issued Jan. 21, 1986, U.S. Pat. No. 4,114,669, issued Sep. 19, 1978, U.S. Pat. No. 2,453,001, issued Nov. 2, 1948, U.S. Pat. No. 4,142,565, issued Mar. 6, 1979, U.S. Pat. No. 5,102,537, issued Apr. 7, 1992, U.S. Pat. No. 4,688,473, issued Aug. 25, 1987, U.S. Pat. No. 3,116,774, issued Jan. 7, 1964, U.S. Pat. No. 5,005,531, issued Apr. 9, 1991, U.S. Pat. No. 5,219,403, issued Jun. 15, 1993, U.S. Pat. No. 1,633,988, issued Jun. 28, 1927, and U.S. Pat. No. 4,556,082, issued Dec. 3, 1985.

None of these patents disclose a sleeve means specifically adapted or suitable for use with an outlet pipe having an outlet opening disposed above a drain structure to attain the above mentioned objectives of the present invention.

DISCLOSURE OF INVENTION

The apparatus of the present invention is for use in combination with a generally vertically oriented outlet pipe having a lower distal pipe end defining an outlet opening for emitting fluid material. The outlet pipe has an outer circumferential surface of pre-determinable magnitude.

Drain structure is disposed below the outlet pipe and is spaced from the lowermost pipe end. The drain structure has an upper drain structure end defining an inlet opening for receiving fluid material emitted from the outlet opening of the lower distal pipe end of the outlet pipe. The upper drain structure end has an outer circumferential surface at the inlet opening defined thereby of a magnitude greater than the determinable magnitude of the outer circumferential surface of the outlet pipe.

The apparatus is for confining fluid emissions from either the outlet pipe or the drain structure and substantially preventing the fluid emissions from entering the ambient atmosphere.

A sleeve member for extension between the outlet pipe and the upper drain structure end has a first sleeve end for releasable connection to and for extension completely about the outlet pipe. A second sleeve end is for releasable connection to and extension about the upper drain structure end.

An intermediate sleeve segment is affixed to the first and second sleeve ends and defines a fluid flow passageway isolated from the ambient atmosphere.

The first and second sleeve ends each are of cylindrical configuration and the second sleeve end has a substantially greater diameter than the outside diameter of the first sleeve end. The intermediate sleeve segment is of truncated cone configuration, flaring outwardly and downwardly from the first sleeve end to the second sleeve end.

The sleeve ends and the intermediate sleeve section are of unitary construction and formed from flexible, multi-layer sheet material. At least the innermost layer of the flexible, multi-layer sheet material is chemically non-reactive with the fluid emissions. The sleeve ends are substantially concentric and the sheet material is sufficiently stiff to enable the sleeve member to retain its shape when unsupported.

Other features, advantages, and objects of the present invention will become apparent with reference to the following description and accompanying drawings.

BEST MODE FOR CARRYING OUT THE INVENTION

Figure 1:
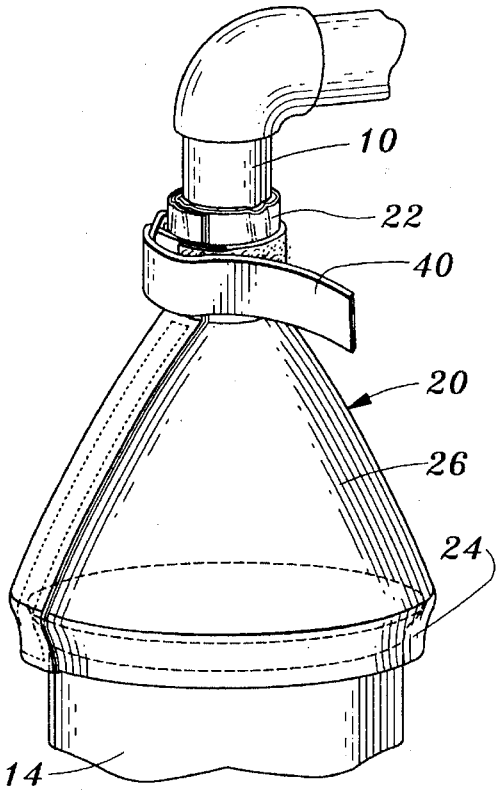
FIG. 1 is a perspective view of a representative drainage site including an outlet pipe and drain structure with a sleeve member constructed in accordance with the teachings of the present invention in place between the outlet pipe and drain structure to provide a fugitive emission seal therebetween.

Referring now to the drawings, a vertically oriented outlet pipe is designated by reference numeral 10. Outlet pipe 10 has a lower distal end defining an outlet opening 12 for emitting fluid material. The other end of the outlet pipe (not shown) is located at any suitable source of such fluid material such as a petrochemical product storage tank (also not shown). The outlet pipe has an outer circumferential surface of determinable magnitude.

Drain structure 14 is disposed below the outlet pipe 10 and spaced from the lower distal pipe end. The drain structure 14 is of conventional construction and has an upper drain structure end defining an inlet opening 16 for receiving fluid material emitted from the outlet opening of the lower distal pipe end of the outlet pipe. The upper drain structure end has an outer circumferential surface at the outlet opening defined thereby of a magnitude greater than the determinable magnitude of the outer circumferential surface of the outlet pipe. In the drawings, the inlet opening 16 is defined by an outwardly flanged or tapered drain structure end; however, it is to be understood that the upper drain structure end can be of any other suitable configuration such as cylindrical. The drain structure of the type illustrated is conventionally located relative to a surrounding surface to direct drainage from ground level to a subterranean pipe; however, use of the present invention is not limited to such an environment.

It will be appreciated that the arrangement just disclosed can result in the generation and dissemination into the ambient atmosphere of fugitive emissions from the outlet pipe, the drain structure or both, this being a particular problem when there are windy conditions. Furthermore, splashing of liquid can occur at the drain site. Exposure to the elements at the drain site can also cause freezing of certain materials.

Figure 3:
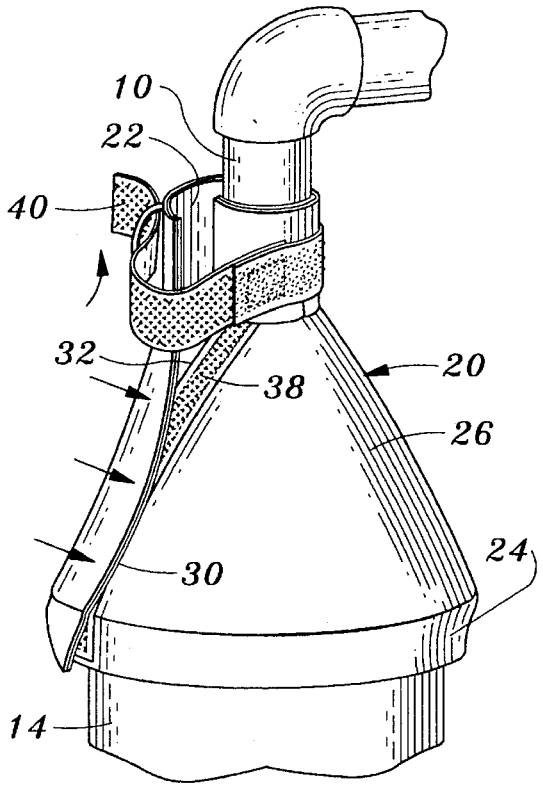
FIG. 3 is a view similar to FIGS. 1 and 2 but illustrating the condition of the sleeve member between the two configurations disclosed in FIGS. 1 and 2 during application.
Figure 2:
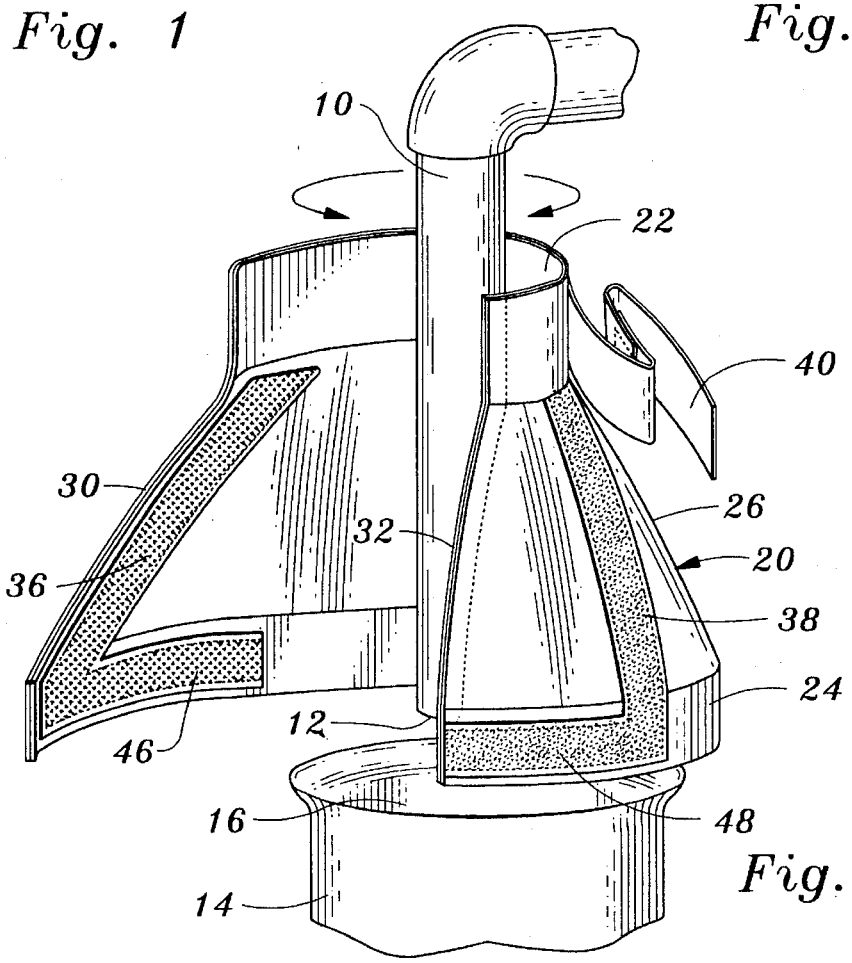
FIG. 2 is a view similar to FIG. 1 but illustrating the sleeve member in the process of being assembled in place relative to the outlet pipe and drain structure.
Figure 4:
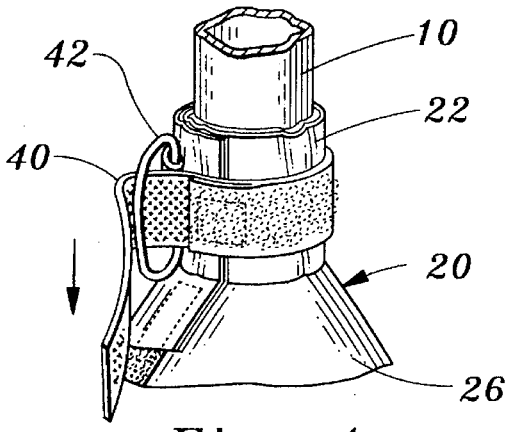
FIG. 4 is a detail view of a segment of the sleeve member illustrating details of releasable securement means employed to secure the top of the sleeve member to the outlet pipe.
Figure 5:
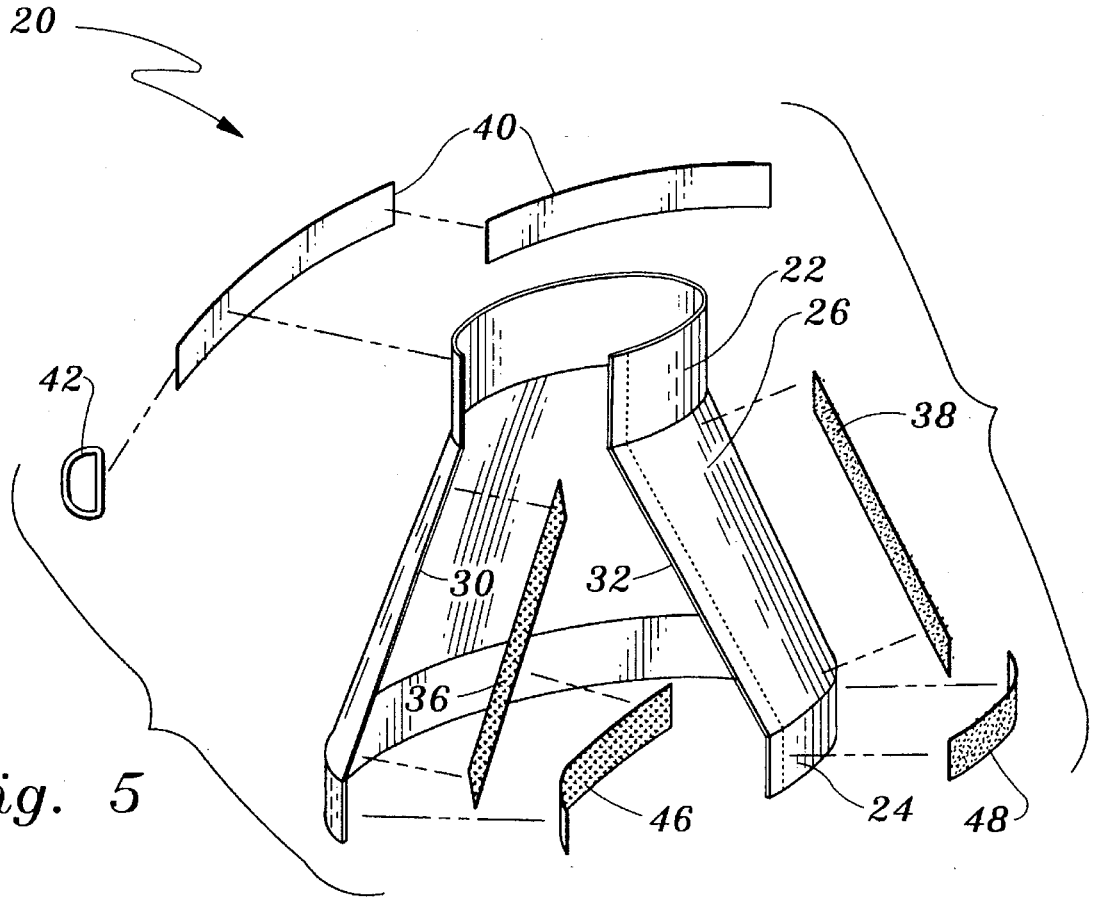
FIG. 5 is an exploded view illustrating components of the sleeve member, including components of the releasable securement means of the sleeve member.

In accordance with the teachings of the present invention, a sleeve member 20 of specialized construction is mounted on the outlet pipe and the upper drain structure end to prevent generation and escape of fugitive emissions by defining a closed fluid passageway isolated from the ambient atmosphere. FIG. 1 shows the sleeve member 20 secured in position and FIGS. 2, 3 and 4 show sequential stages involved during application of the sleeve member to and between the outlet pipe 10 and drain structure 14.

Sleeve member 20 has a first sleeve end 22 releasably connected to and extending completely about the outlet pipe. The sleeve member also includes a second sleeve end 24 releasably connected to and extending completely about the upper end of drain structure 14. The first and second sleeve ends are concentric.

An intermediate sleeve segment 26 is affixed to the first and second sleeve ends and defines a fluid flow passageway isolated from the ambient atmosphere to confine fluid emissions from either the outlet pipe or the drain structure and prevent the fluid emissions from entering the ambient atmosphere.

The first and second sleeve ends are each of cylindrical configuration and the second sleeve end 24 has a substantially greater outside diameter than the outside diameter of the first sleeve end. The intermediate sleeve segment 26 has a truncated cone configuration, flaring outwardly and downwardly from the first sleeve end to the second sleeve end.

The sleeve ends 22, 24 and the intermediate sleeve section 26 are of unitary construction and formed from flexible, multi-layer sheet material. At least the innermost layer of the flexible, multi-layer sheet material is chemically non-reactive with the fluid emissions from either the outlet pipe or the drain structure. A particularly suitable material for construction of the innermost layer of the flexible, multi-layer sheet material when the sleeve member is utilized in petrochemical plant applications is fiberglass cloth laminated to aluminum foil. A suitable outermost layer material is vinyl coated nylon.

The layers of the sheet material may be secured together in any desired fashion. Sewing together of the layers with a suitable chemically non-reactive material such as Kevlar thread has been found to be one approach for accomplishing this. Although the sleeve ends and intermediate sleeve segment are of unitary construction as previously described, the shape of the sleeve member dictates that the sleeve ends and the intermediate sleeve segment be separate sheet material components which are secured together in some fashion to attain the sleeve member construction.

The sheet material utilized to construct the sleeve member is flexible but it is preferred that the multi-layer sheet material be sufficiently rigid to enable the sleeve ends to retain the cylindrical configurations and the intermediate sleeve section to retain its truncated cone configuration when the sleeve member is unsupported. This will serve to maintain proper placement of the sleeve member relative to the outlet pipe and drain structure even if the sleeve ends are not tightly secured in place in a manner which will now be described.

The sleeve member includes releasable securement means releasably securing the sleeve member to the outlet pipe and to the upper drain structure end. The sheet material has free sheet ends 30, 32 running from one end to the other so that the sleeve member may be completely opened as shown in FIG. 2 to install or remove the sleeve member relative to the outlet pipe and the drain structure (see FIG. 2, for example). The releasable securement means which will now be described not only provides for the securement of the sleeve member in place but also to attain the sleeve member configuration described above when the sleeve member is secured in place.

A first strip 36 of synthetic hook and loop fastener material is sewn or otherwise secured to the inner surface of the intermediate sleeve segment 26 adjacent to and extending parallel to sheet end 30. A second strip 38 of synthetic hook and loop fastener material is secured to the outer surface of the intermediate sleeve segment adjacent to and extending parallel to the free sheet end 32. When the sleeve member is secured in place as shown in FIG. 1, the strips 36, 38 are in engagement and maintain the intermediate sleeve segment in its truncated cone configuration.

A binding strap 40 is secured to the first sleeve end and extends about the first sleeve end to bind the first sleeve end into tight engagement with the outer circumferential surface of the outlet pipe as shown in FIG. 1. The binding strap is sewn to or otherwise secured in place and has synthetic hoop and loop fastener material which can be utilized to releasably secure the binding strap to itself as shown in FIG. 1. In the arrangement illustrated, a ring or loop element 42 is attached to the first sleeve end 22 to receive the binding strap as shown in FIG. 3 whereby the binding strap may be doubled back upon itself as shown in FIG. 4 to bring the synthetic hoop and loop fastener material of the binding strap into engagement.

Extending from securement strips 36, 38 are strips 46, 48, respectively, extending partially along second sleeve end 24. Strip 46 is attached to the inner layer or surface of second sleeve end 24 and strip 48 is affixed to the outer surface thereof. Strips 46, 48 are brought into engagement as shown in FIGS. 1 and 3 to secure the bottom of the sleeve member to the drain structure. It will be noted that the free sheet ends are in overlapped abutting condition when the intermediate sleeve segment is in its truncated cone configuration to provide an effective seal between the inner passageway defined by the sleeve member and the ambient atmosphere.

We claim:

1. In combination:

a generally vertically oriented outlet pipe having a lower distal pipe end defining an outlet opening for emitting fluid material, said outlet pipe having an outer circumferential surface of determinable magnitude;

drain structure disposed below said outlet pipe and spaced from said lower distal pipe end, said drain structure having an upper drain structure end defining an inlet opening for receiving fluid material emitted from the outlet opening of the lower distal pipe end of said outlet pipe, said upper drain structure end having an outer circumferential surface at the inlet opening defined thereby of a magnitude greater than the determinable magnitude of the outer circumferential surface of said outlet pipe; and a sleeve member extending between said outlet pipe and said upper drain structure end, said sleeve member having a first sleeve end releasably connected to and extending completely about the outlet pipe, a second sleeve end releasably connected to and extending completely about the upper drain structure end, and an intermediate sleeve segment affixed to said first and second sleeve ends and defining a fluid flow passageway isolated from the ambient atmosphere to confine fluid emissions from either said outlet pipe or said drain structure and substantially prevent said fluid emissions from entering the ambient atmosphere, said first and second sleeve ends each being of substantially cylindrical configuration and said second sleeve end having a substantially greater outside diameter than the outside diameter of said first sleeve end, and said intermediate sleeve segment having a truncated cone configuration, flaring outwardly and downwardly from said first sleeve end to said second sleeve end, said first and second sleeve ends being substantially concentric, said sleeve ends and said intermediate sleeve section being of unitary construction and formed from flexible, multi-layer sheet material, at least the innermost layer of said flexible, multi-layer sheet material being chemically non-reactive with said fluid emissions.

2. The combination according to claim 1 wherein said innermost layer of said flexible, multi-layer sheet material is fiberglass cloth laminated to aluminum foil.

3. The combination according to claim 2 wherein the outermost layer of said flexible, multi-layer sheet material is vinyl coated nylon.

4. The combination according to claim 1 wherein first and second sleeve ends and said intermediate sleeve segment are sewn together and wherein said flexible, multi-layer sheet material is sufficiently rigid to enable said sleeve ends to retain their cylindrical configurations and said intermediate sleeve section to retain said truncated cone configuration when said sleeve member is unsupported.

5. Apparatus for use in combination with a generally vertically oriented outlet pipe having a lower distal pipe end defining an outlet opening for emitting fluid material, said outlet pipe having an outer circumferential surface of determinable magnitude and drain structure disposed below said outlet pipe and spaced from said lower distal pipe end, said drain structure having an upper drain structure end defining an inlet opening for receiving fluid material emitted from the outlet opening of the lower distal pipe end of said outlet pipe, said upper drain structure end having an outer circumferential surface at the inlet opening defined thereby of a magnitude greater than the determinable magnitude of the outer circumferential surface of said outlet pipe, said apparatus for confining fluid emissions from either said outlet pipe or said drain structure and substantially prevent said fluid emissions from entering the ambient atmosphere and comprising a sleeve member for extension between said outlet pipe and said upper drain structure end, said sleeve member having a first sleeve end for releasable connection to and for extension completely about the outlet pipe, a second sleeve end for releasable connection to and extension completely about the upper drain structure end, and an intermediate sleeve segment affixed to said first and second sleeve ends and defining a fluid flow passageway isolated from the ambient atmosphere, said first and second sleeve ends each being of substantially cylindrical configuration and said second sleeve end having a substantially greater outside diameter than the outside diameter of said first sleeve end, and said intermediate sleeve segment being of truncated cone configuration, flaring outwardly and downwardly from said first sleeve end to said second sleeve end, said sleeve ends and said intermediate sleeve section being of unitary construction and formed from flexible, multi-layer sheet material, at least the innermost layer of said flexible, multi-layer sheet material being chemically non-reactive with said fluid emissions, said sleeve ends being substantially concentric and said sheet material being sufficiently stiff to enable said sleeve member to retain its shape when unsupported.

6. The apparatus according to claim 5 wherein said innermost layer of said flexible, multi-layer sheet material is fiberglass cloth laminated to aluminum foil.

7. The apparatus according to claim 6 wherein the outermost layer of said flexible, multi-layer sheet material is vinyl coated nylon.

8. The apparatus according to claim 5 wherein said sleeve member additionally comprises releasable securement means releasably securing said sleeve member to said outlet pipe and to said upper drain structure end, said sleeve ends and said intermediate sleeve section being of unitary construction and formed from sheet material having free sheet ends extending the length of said sleeve member, said releasable securement means including synthetic hook and loop fastener material on said sheet material.

9. The apparatus according to claim 8 wherein said synthetic hook and loop fastener material includes a first strip of fastener material on the inner surface of said intermediate sleeve segment adjacent to and extending parallel to one of said free sheet ends and a second strip of fastener material on the outer surface of said intermediate sleeve segment adjacent to and extending parallel to the other of said free sheet ends, said first and second strips of fastener material when in engagement maintaining said intermediate sleeve segment in a truncated cone configuration.

10. The apparatus according to claim 8 wherein said releasable securement means additionally includes a binding strap on said first sleeve end extending about said first sleeve end for binding said first sleeve end in tight engagement with the outer circumferential surface of said outlet pipe.

11. The apparatus according to claim 10 wherein said releasable securement means additionally comprises a loop element attached to said first sleeve end receiving said binding strap.

12. The apparatus according to claim 11 wherein said binding strap includes synthetic hook and loop fastener material releasably securing said binding strap to itself.

13. In combination:

a generally vertically oriented outlet pipe having a lower distal pipe end defining an outlet opening for emitting fluid material, said outlet pipe having an outer circumferential surface of determinable magnitude;

drain structure disposed below said outlet pipe and spaced from said lower distal pipe end, said drain structure having an upper drain structure end defining an inlet opening for receiving fluid material emitted from the outlet opening of the lower distal pipe end of said outlet pipe, said upper drain structure end having an outer circumferential surface at the inlet opening defined thereby of a magnitude greater than the determinable magnitude of the outer circumferential surface of said outlet pipe; and a sleeve member extending between said outlet pipe and said upper drain structure end, said sleeve member having a first sleeve end releasably connected to and extending completely about the outlet pipe, a second sleeve end releasably connected to and extending completely about the upper drain structure end, and an intermediate sleeve segment affixed to said first and second sleeve ends and defining a fluid flow passageway isolated from the ambient atmosphere to confine fluid emissions from either said outlet pipe or said drain structure and substantially prevent said fluid emissions from entering the ambient atmosphere, said sleeve member additionally comprising releasable securement means releasably securing said sleeve member to said outlet pipe and to said upper drain structure end, said sleeve ends and said intermediate sleeve section being of unitary construction and formed from sheet material having free sheet ends extending the length of said sleeve member between said outlet pipe and said drain structure, and said releasable securement means including synthetic hook and loop fastener material on said sheet material.

14. The combination according to claim 13 wherein said releasable securement means additionally includes a binding strap on said first sleeve end extending about said first sleeve end and binding said first sleeve end in tight engagement with the outer circumferential surface of said outlet pipe.

15. The combination according to claim 14 wherein said releasable securement means additionally comprises a loop element attached to said first sleeve end receiving said binding strap.

16. The combination according to claim 15 wherein said binding strap includes synthetic hook and loop fastener material releasably securing said binding strap to itself.

17. The combination according to claim 13 wherein said synthetic hook and loop fastener material includes a first strip of fastener material on the inner surface of said intermediate sleeve segment adjacent to and extending parallel to one of said free sheet ends and a second strip of fastener material on the outer surface of said intermediate sleeve segment adjacent to and extending parallel to the other of said free sheet ends, said first and second strips of fastener material in engagement to maintain said intermediate sleeve segment in a truncated cone configuration.

18. The combination according to claim 17 wherein said first and second strips of fastener material maintain said free sheet ends in overlapped abutting condition.

* * * * *